US010992074B2

(12) United States Patent
Deng et al.

(10) Patent No.: US 10,992,074 B2
(45) Date of Patent: Apr. 27, 2021

(54) ELECTRICAL CABLE CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yu-Jia Deng, Kunshan (CN); Bin Peng, Kunshan (CN); Jian-Kuang Zhu, Kunshan (CN); Kuo-Chun Hsu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/746,813

(22) Filed: Jan. 18, 2020

(65) Prior Publication Data

US 2020/0243998 A1 Jul. 30, 2020

(30) Foreign Application Priority Data

Jan. 28, 2019 (CN) ..... 201920140235.9

(51) Int. Cl.
*H01R 13/11* (2006.01)
*H01R 13/52* (2006.01)
*H01R 13/41* (2006.01)

(52) U.S. Cl.
CPC ..... *H01R 13/113* (2013.01); *H01R 13/41* (2013.01); *H01R 13/521* (2013.01)

(58) Field of Classification Search
CPC .. H01R 13/113; H01R 12/515; H01R 13/112; H01R 12/57; H01R 12/53; H01R 13/11;
(Continued)

(56) References Cited

U.S. PATENT DOCUMENTS 5,551,883 A * 9/1996 Davis ..... H01R 24/62 439/65
5,951,331 A * 9/1999 Li-Ming ..... H01R 13/26 439/682

(Continued)

FOREIGN PATENT DOCUMENTS

CN 205319424 U 6/2016

*Primary Examiner* — Edwin A. Leon
*Assistant Examiner* — Matthew T Dzierzynski
(74) *Attorney, Agent, or Firm* — Ming Chieh Chang; Wei Te Chung

(57) ABSTRACT

An electrical connector includes an insulative housing, a plurality of passageways, a plurality of blade type contacts retained to the retaining grooves in the corresponding passageways, a spacer located in a rear receiving space of the housing with corresponding slits through which tails of the contacts rearwardly extend, and a plurality of wires having the inner conductors soldered upon the tails of the contacts behind the spacer. A waterproof glue plate fills the receiving space of the housing to enclose the exposed inner conductors and the corresponding tails. A plurality of passages are formed in one side of the peripheral wall, through which the wires extend in a vertical direction perpendicular to the horizontal direction along which the contacts extend. The spacer forms a recess to receive a protrusion of the glue plate, and the protrusion is located adjacent to the passages for assuring sealing around said passages.

20 Claims, 17 Drawing Sheets

(58) Field of Classification Search
CPC H01R 13/187; H01R 13/428; H01R 2101/00; H01R 4/4818; H01R 12/70; H01R 12/716; H01R 12/724; H01R 13/04; H01R 13/62; H01R 2201/26; H01R 43/20; H01R 12/707; H01R 12/75; H01R 4/023
USPC ..... 439/694, 855, 881, 902, 276, 936
See application file for complete search history.

(56) References Cited

U.S. PATENT DOCUMENTS 6,171,126 B1 * 1/2001 Wu ..... H01R 11/282 439/224
6,837,745 B2 * 1/2005 Takada ..... H01R 13/562 439/521
6,971,923 B1 * 12/2005 Wu ..... H01R 9/03 439/606
7,070,456 B1 * 7/2006 Peng ..... H01R 13/10 439/224
7,553,167 B2 * 6/2009 Zhang ..... H01R 4/2433 439/497
7,677,919 B1 * 3/2010 Lin ..... H01R 13/113 439/500
7,802,994 B1 * 9/2010 Chen ..... H01R 12/732 439/65
8,419,482 B1 * 4/2013 Yu ..... H01R 12/724 439/682
8,870,605 B2 * 10/2014 Hung ..... H01R 13/112 439/682
9,263,815 B2 * 2/2016 Yu ..... H01R 13/112
9,287,643 B2 * 3/2016 Yoshida ..... H01R 12/75
9,711,897 B2 * 7/2017 Ho ..... H01R 13/113
10,826,226 B2 * 11/2020 Yin ..... H01R 12/592
2001/0034163 A1 * 10/2001 Chiang ..... H01R 13/26 439/660
2011/0223811 A1 * 9/2011 Hsueh ..... H01R 12/716 439/629
2013/0164996 A1 * 6/2013 Miyakawa ..... H01R 13/506 439/694
2019/0356077 A1 * 11/2019 Murakami ..... H01R 13/50
2020/0203872 A1 * 6/2020 Niitsu ..... H01R 13/24

* cited by examiner

ELECTRICAL CABLE CONNECTOR

BACKGROUND OF THE DISCLOSURE

1. Field of the Disclosure

The present disclosure relates to an electrical connector, and particularly to the electrical connector with the associated wires connected to the blade type contacts.

2. Description of Related Arts

The convention cable connector discloses the inner conductors of the wires soldered upon the tails of the blade type contacts behind the rear face of the housing, and a waterproof glue plate is further applied into a rear receiving space of the housing to cover the rear face of the housing. Anyhow, for the wires extending in the vertical direction perpendicular to a horizontal direction along which the contacts extend, the peripheral wall formed by the housing surrounding the receiving cavity is required to form a plurality of passages for allowing the corresponding wires to extend along the vertical direction. Because such passages are aligned with the receiving space in the vertical direction, it may result in leakage during filling the waterproof glue in the receiving space, thus jeopardizing sealing thereabouts.

An improved connector is desired to provide the electrical cable connector with the good waterproofing function for the wires extending in the vertical direction perpendicular to the horizontal direction along which the contacts extend.

SUMMARY OF THE DISCLOSURE

An object of the invention is to provide an electrical connector with an insulative housing, a plurality of passageways, a contact module including a plurality of blade type contacts retained to the retaining grooves in the corresponding passageways, a spacer located in a rear receiving space of the housing and behind the passageways for covering the passageways with corresponding slits through which tails of the contacts rearwardly extend, and a plurality of wires having the inner conductors soldered upon the tails of the contacts behind the spacer. A waterproof glue plate fills the receiving space of the housing to enclose the exposed inner conductors and the corresponding tails. A peripheral wall is formed on a rear side of the housing, and forms therein the aforementioned rear receiving space which further forwardly extends into the rear side of the housing with a distance so as to receive the spacer therein. A plurality of passages are formed in one side of the peripheral wall, through which the wires extend in a vertical direction perpendicular to the horizontal direction along which the contacts extend. The spacer forms a recess to receive a protrusion of the glue plate, and the protrusion is located adjacent to the passages for assuring sealing around said passages.

Other objects, advantages and novel features of the disclosure will become more apparent from the following detailed description when taken in conjunction with the accompanying drawings.

DETAILED DESCRIPTION OF THE PREFERRED EMBODIMENT

Figure 6:
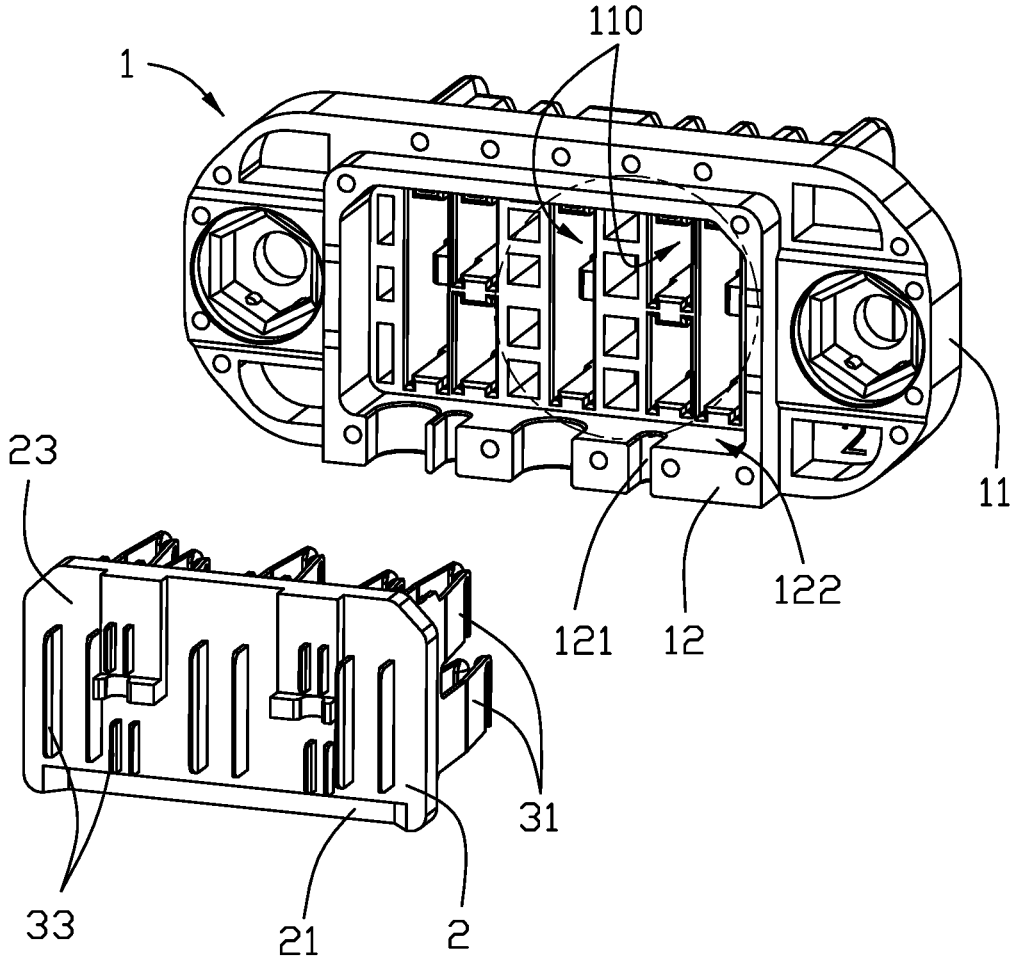
FIG. 6 is another further exploded perspective view of the electrical connector of FIG. 4
Figure 7:
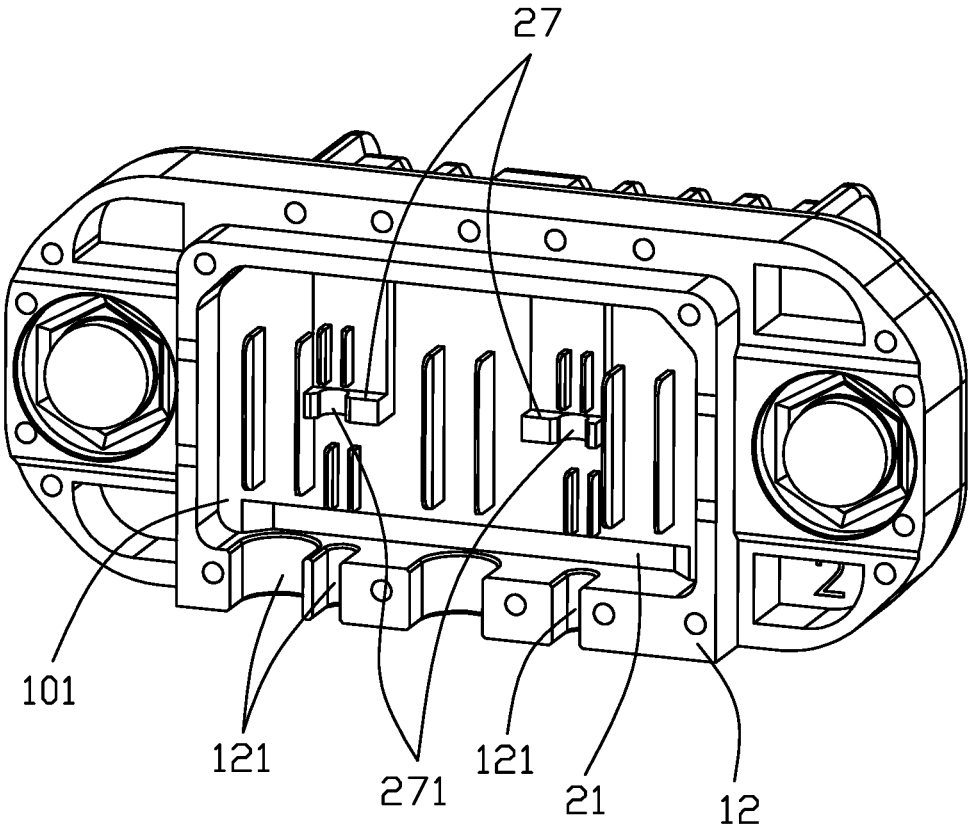
FIG. 7 is a perspective view of the electrical connector of FIG. 1.
Figure 8:
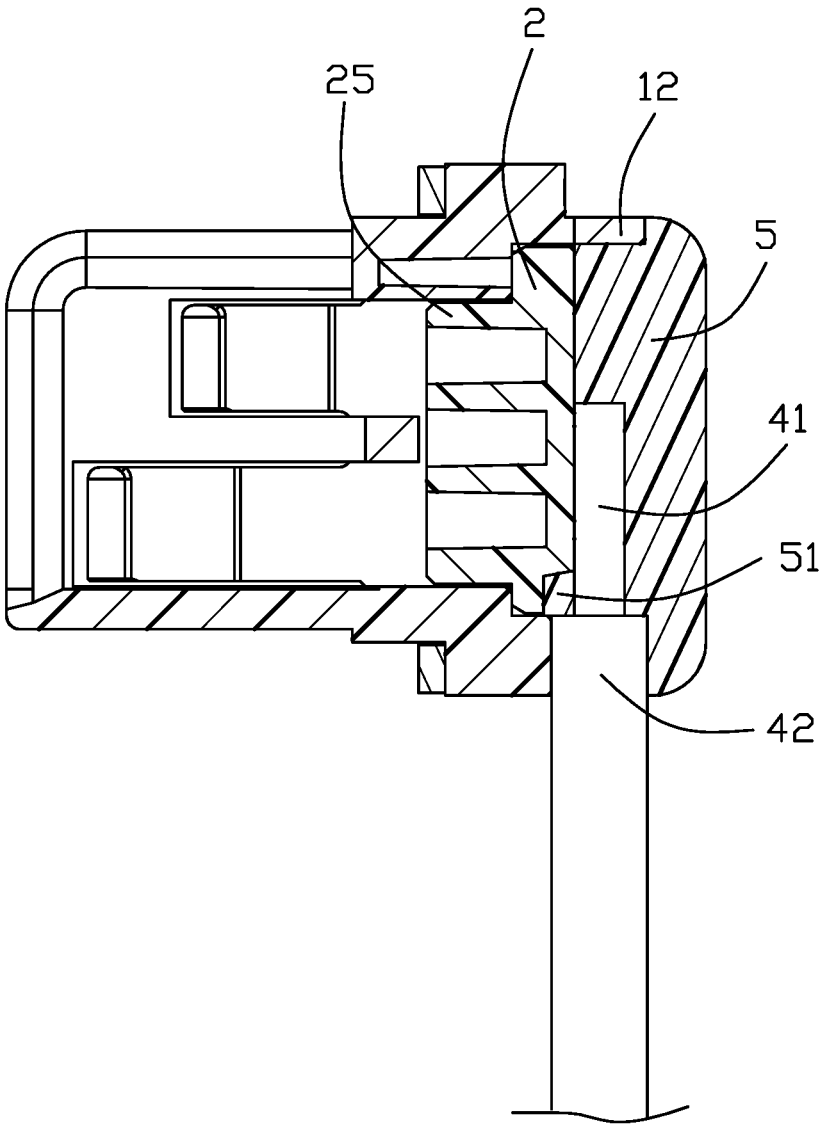
FIG. 8 is a cross-sectional view of the electrical connector of FIG. 1.
Figure 8A:
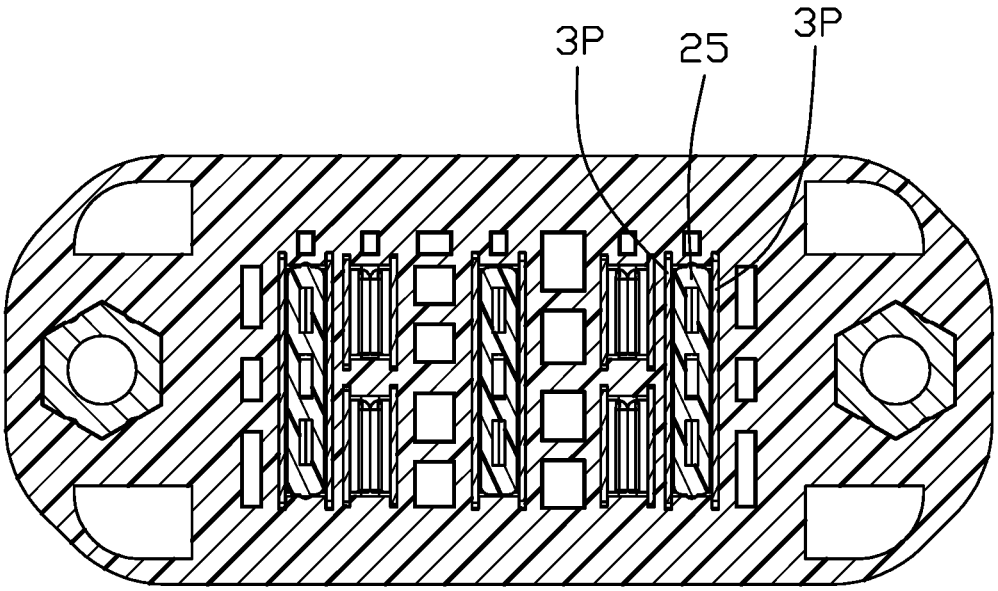
FIG. 8(A) is another cross-sectional view of the electrical connector of FIG. 1.
Figure 9:
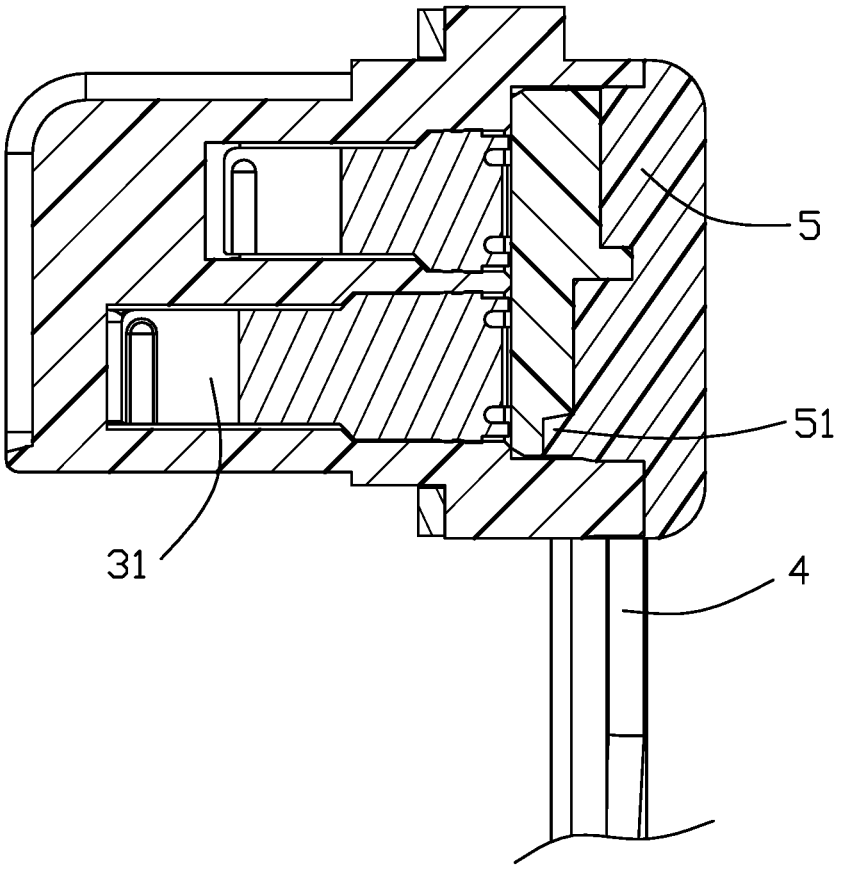
FIG. 9 is another cross-sectional view of the electrical connector of FIG. 1.

Referring to FIGS. 1-12, an electrical connector 1000 includes an insulative subassembly 100, a plurality of contacts 3 retained to the insulative subassembly 100, a plurality of wires 4 secured to the contacts 3, and a waterproof glue plate 5 located on a rear side of the insulative subassembly 100. The insulative subassembly 100 is composed of an insulative housing 1 and an insulative spacer 2. The spacer 2 defines a rear face 101 and the tails 33 of the contacts extend rearwardly beyond the rear face 101. Each wire 4 includes an inner conductor 41 enclosed within an insulator 42. The wire 4 is positioned upon the rear face 101 and soldered to the corresponding tail 33. The glue plate 3 is located behind and covers the rear face 101 to further enclose the tails 33 of the contacts and the front end regions of the wires 4. The rear face 101 forms a recess 21, and a corresponding protrusion 51 of the glue plate 5 is received within the recess 21 as shown in FIGS. 8 and 9. The housing 1 forms a peripheral wall 12 on the rear side thereof to form therein a rear receiving space 122 which further forwardly extends into the housing with a distance, in which the spacer 2 is disposed. A plurality of passages 121 are formed in one side of the peripheral wall 12 to snugly receive the corresponding wires 4.

The housing 1 includes a base 11, a mating port 10 forwardly extending from the base 11, and the peripheral wall 12 rearwardly extending from the base 11 to form the rear portion of the rear receiving space 122. The mating port forms a horizontal mating face and a vertical mating face perpendicular to each other. The base 11 forms a pair of holes at two opposite transverse ends for installation of the corresponding screw nuts 105 therein. A plurality of dividers 13 are formed in the mating port 10 including a middle thicker one 131 and two opposite end walls 132. A bottom wall 133 is connected to the dividers 13 in the transverse direction. A plurality of slots 14 are formed between the corresponding dividers 13, respectively, to receive the corresponding contacts 3 and another blade type contact of the mated connector (not shown).

Figure 6A:
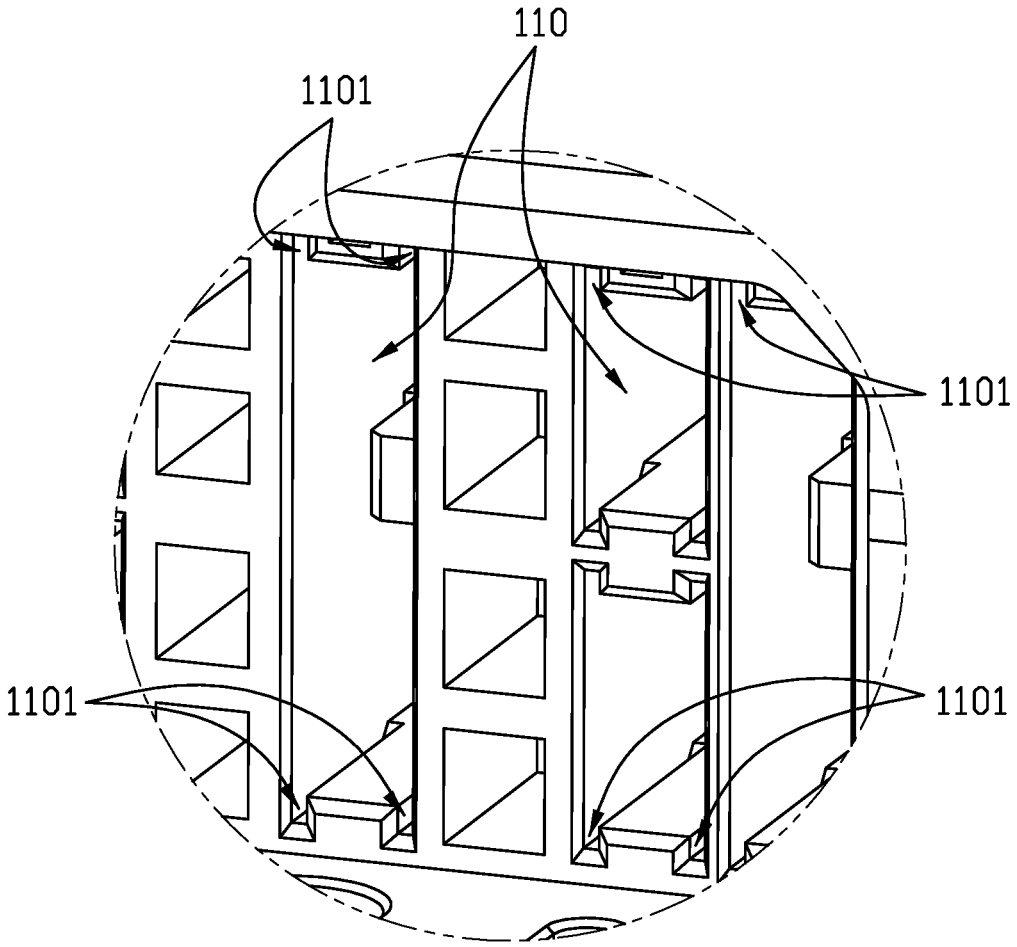
FIG. 6(A) is an enlarged perspective view of a portion of the electrical connector of FIG. 6 to show the corresponding retaining grooves in the corresponding passageways to receive the barbed structures of the contacts.
Figure 6B:
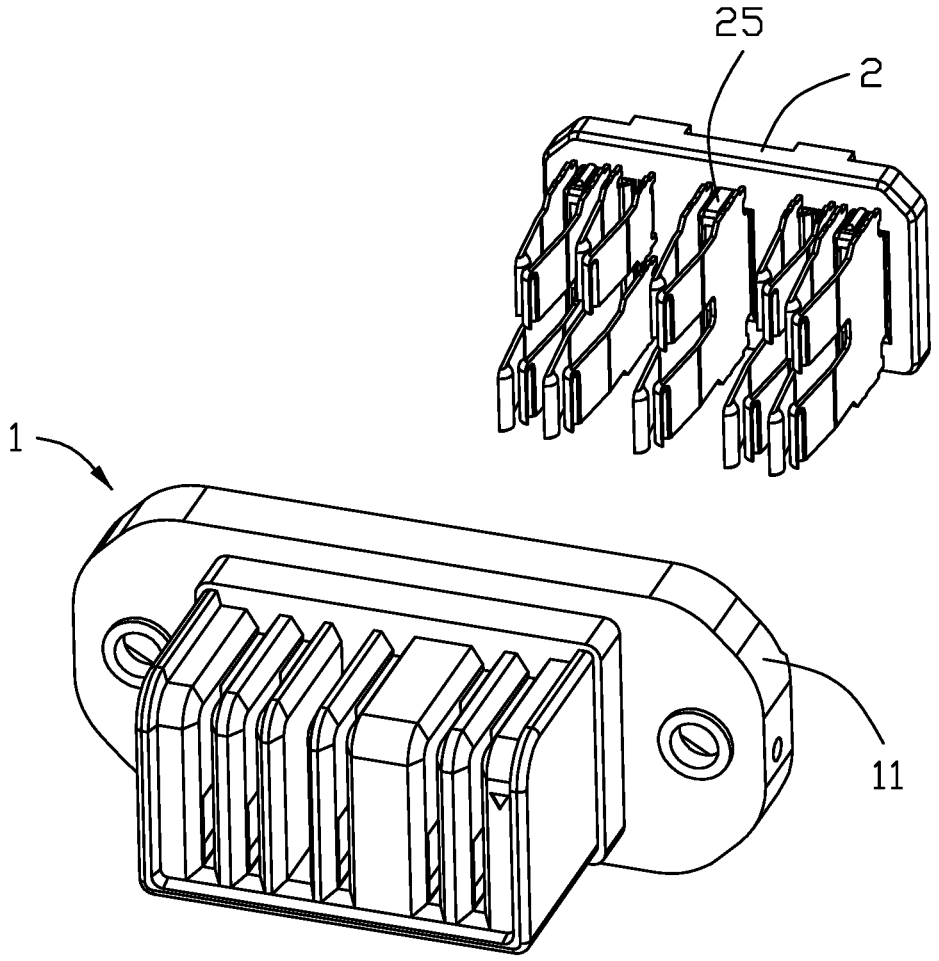
FIG. 6(B) is another perspective view of the electrical connector of FIG. 6.
Figure 6C:
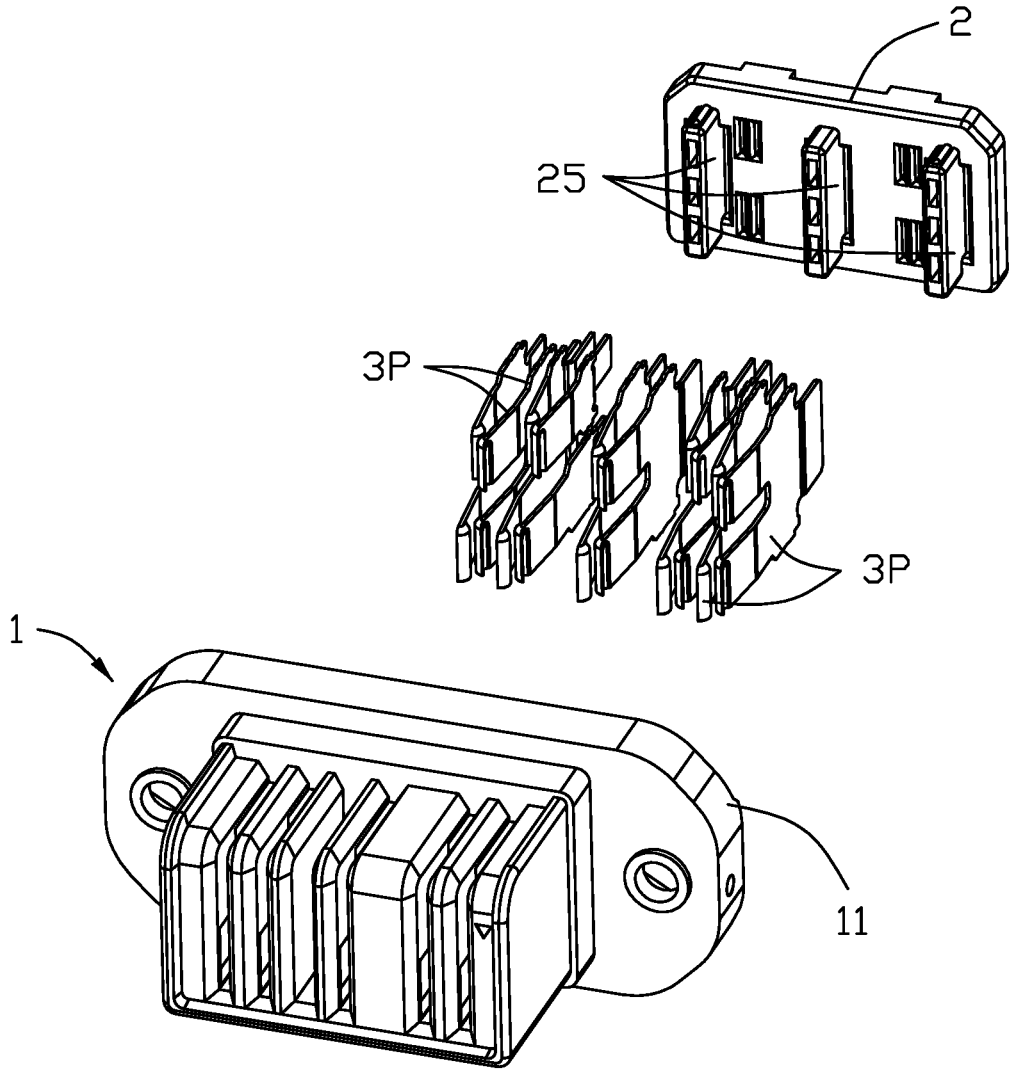
FIG. 6(C) is a further exploded perspective view of the electrical connector of 6(B)
Figure 9A:
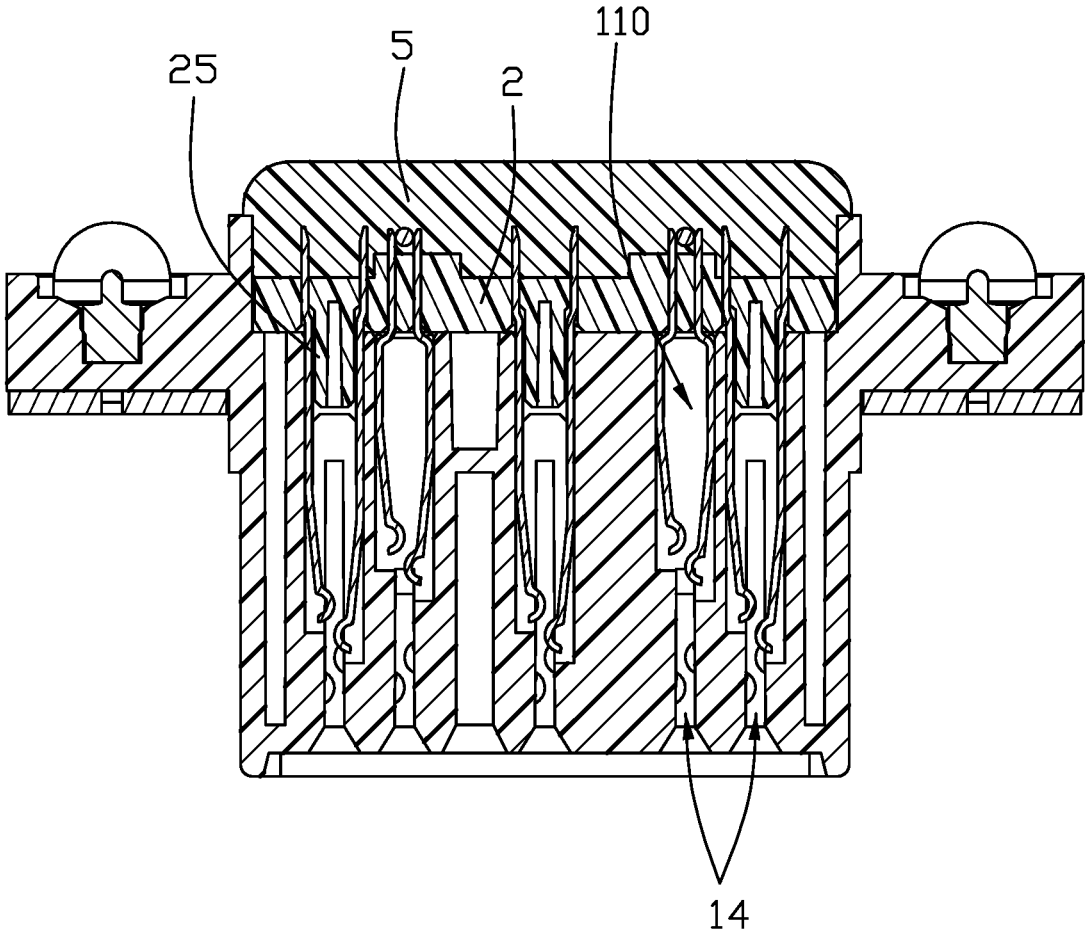
FIG. 9(A) is a cross-sectional view of the electrical connector of FIG. 1.

Referring to FIGS. 6 and 6(A), the base 11 forms a plurality of passageways 110 along the front-to-back direction. A pair of retaining grooves 1101 are formed in two opposite lateral sides of the passageway 110 to receive the two corresponding contacts 3. In fact, each contact 3 has a front contacting section 31, a rear tail 33 and a retaining section 32 therebetween in the front-to-back direction. The contacting section 31 is exposed in the corresponding slot 14 for mating with the aforementioned another blade type contact of the mating connector (not shown). The retaining section 32 having barbed structures is received within the retaining groove 1101 to retain the contact 3 to the housing 1. The tail 33 extends through the corresponding slit 22 in the spacer 2 and beyond the rear face 101 to be exposed within the rear receiving space 122 for soldering to the inner conductor 41 of the corresponding wire 4. The contacts 2 include a plurality of power contacts 3P and signal contacts 3S. The signal contact 3S is relatively small and includes only one contacting section 31 while the power contact 3P is relatively large and includes two spaced contacting sections 31 wherein the signal contacts 3S are paired with one longer one and one shorter one spaced from each other in the vertical direction. As shown in FIG. 9(A), there are four contacting sections 31 commonly disposed within the same one slot 14 wherein those four contacting sections forms four different contacting points in the front-to-back direction while two levels in the vertical direction. As shown in FIGS. 6(C), 8, 8(A) and 9(A), the spacer 2 includes three stuffers 25 on a front face thereof to be received within the corresponding passageways 110 for not only separating the corresponding two power contacts 3(P) from each other in the transverse direction but also enhancing engagement between the spacer 2 and the housing 1.

The wires 4 are received within the corresponding passages 121, respectively, and include the power wires 4P corresponding to the power contacts 3P, and the signal wires 4S corresponding to the signal contacts 3S.

The glue plate 5 is formed in the receiving space 122 and behind the spacer 2 for covering the spacer 2, the tails 33 of the contacts 3 and the exposed inner conductors 41 and the front end region of the insulators 42 of the wires 4. In this embodiment, the glue plate 5 is further bulged beyond the receiving space 122 via a special mold optimally and optionally. The glue plate 5 further includes a protrusion 51 received within the recess 21 so as to enhance the mechanical strength and complete the waterproofing sealing around the passages 121, thus advantageously avoiding the possible cracking of the glue plate around the passages 121 compared with the earlier design in which no recess is formed in the spacer and no protrusion is formed on the glue plate to be retained in the recess around the passages through which the wires extend in a vertical direction perpendicular to the horizontal direction along which the contact extends.

Figure 1:
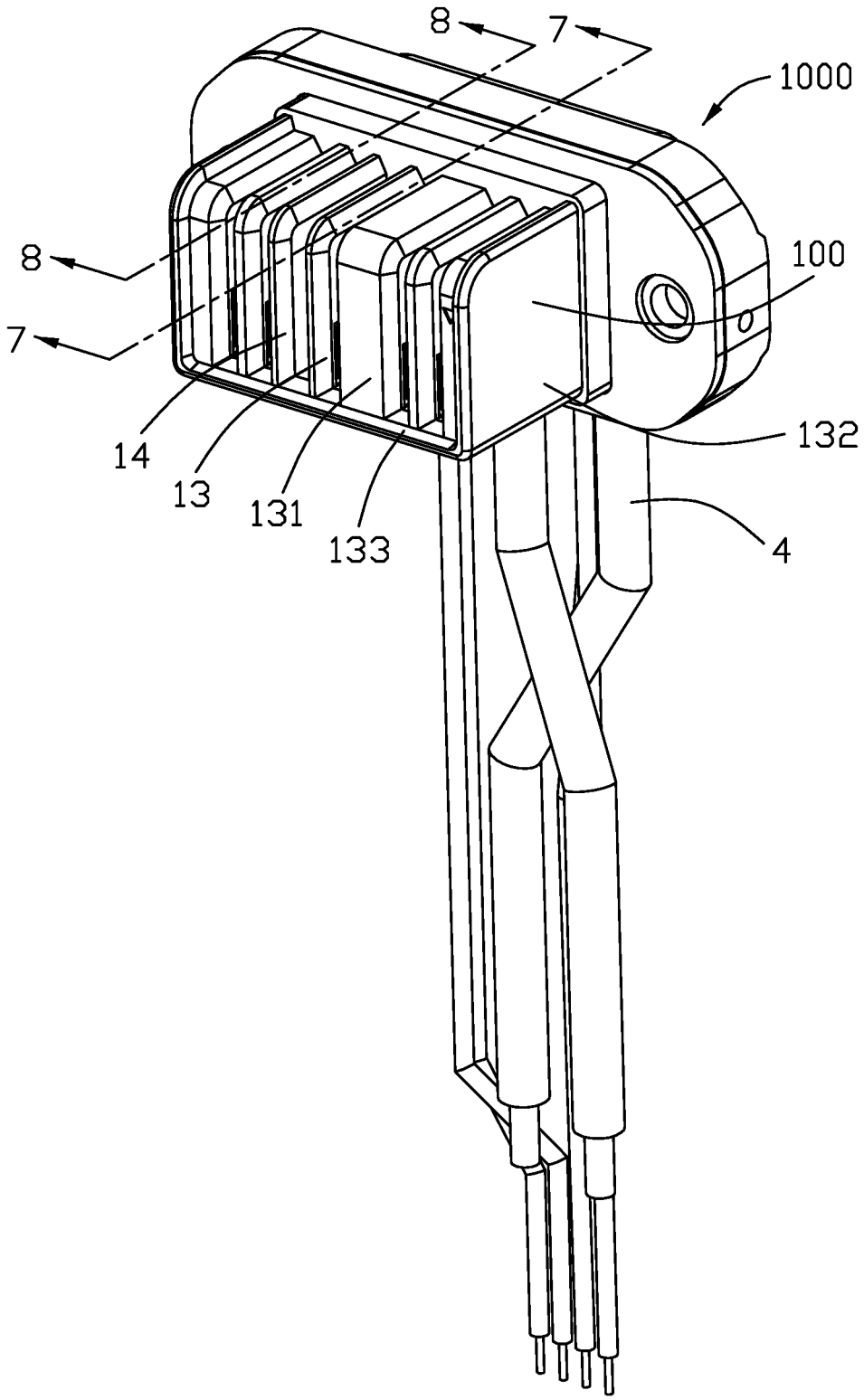
FIG. 1 is a perspective view of an electrical connector according to the first embodiment of the invention.
Figure 2:
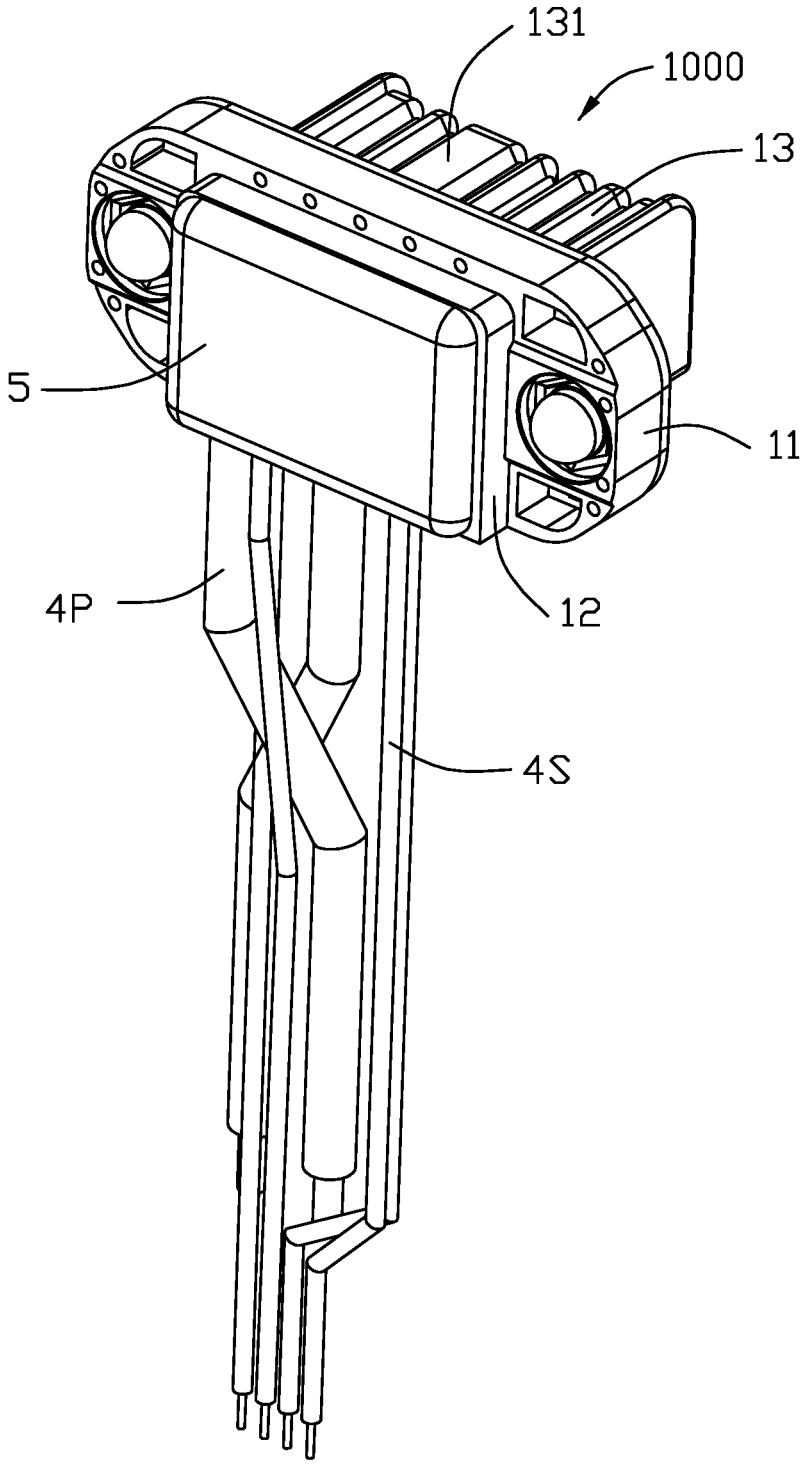
FIG. 2 is another perspective view of the electrical connector of FIG. 1.
Figure 3:
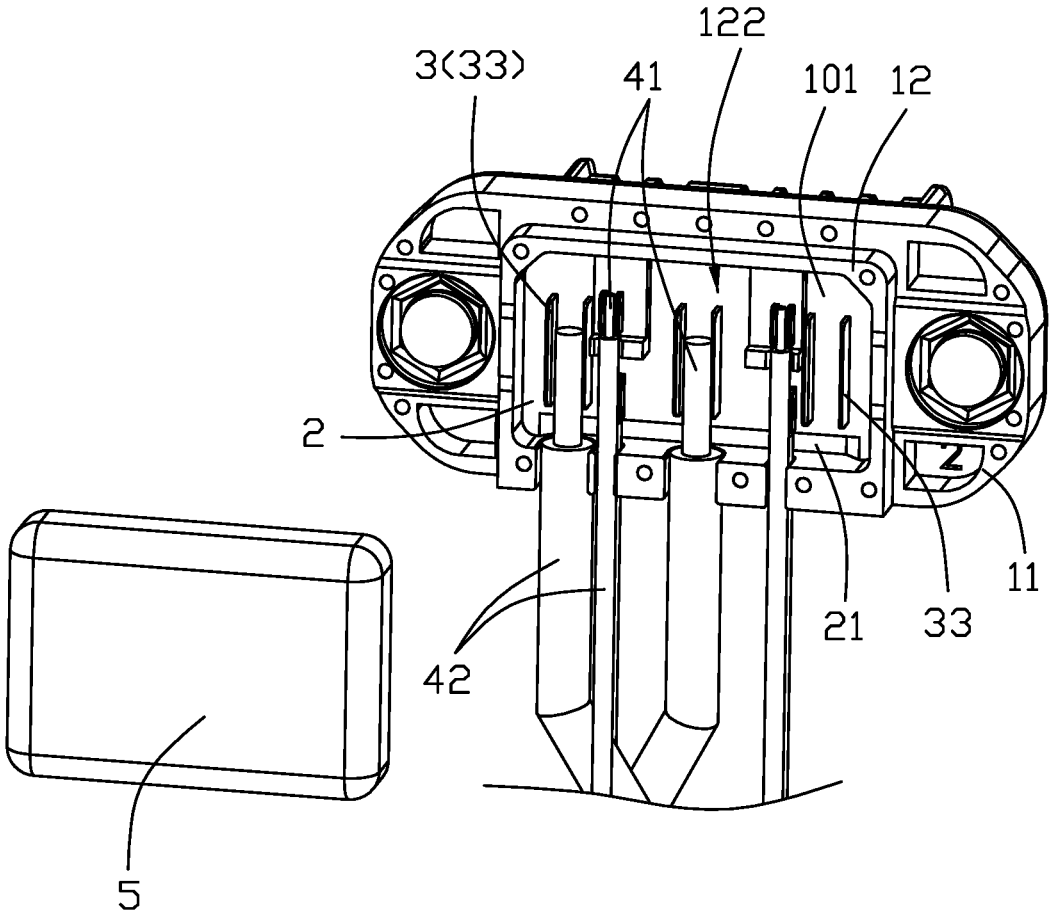
FIG. 3 is an exploded perspective view of the electrical connector of FIG. 1.
Figure 4:
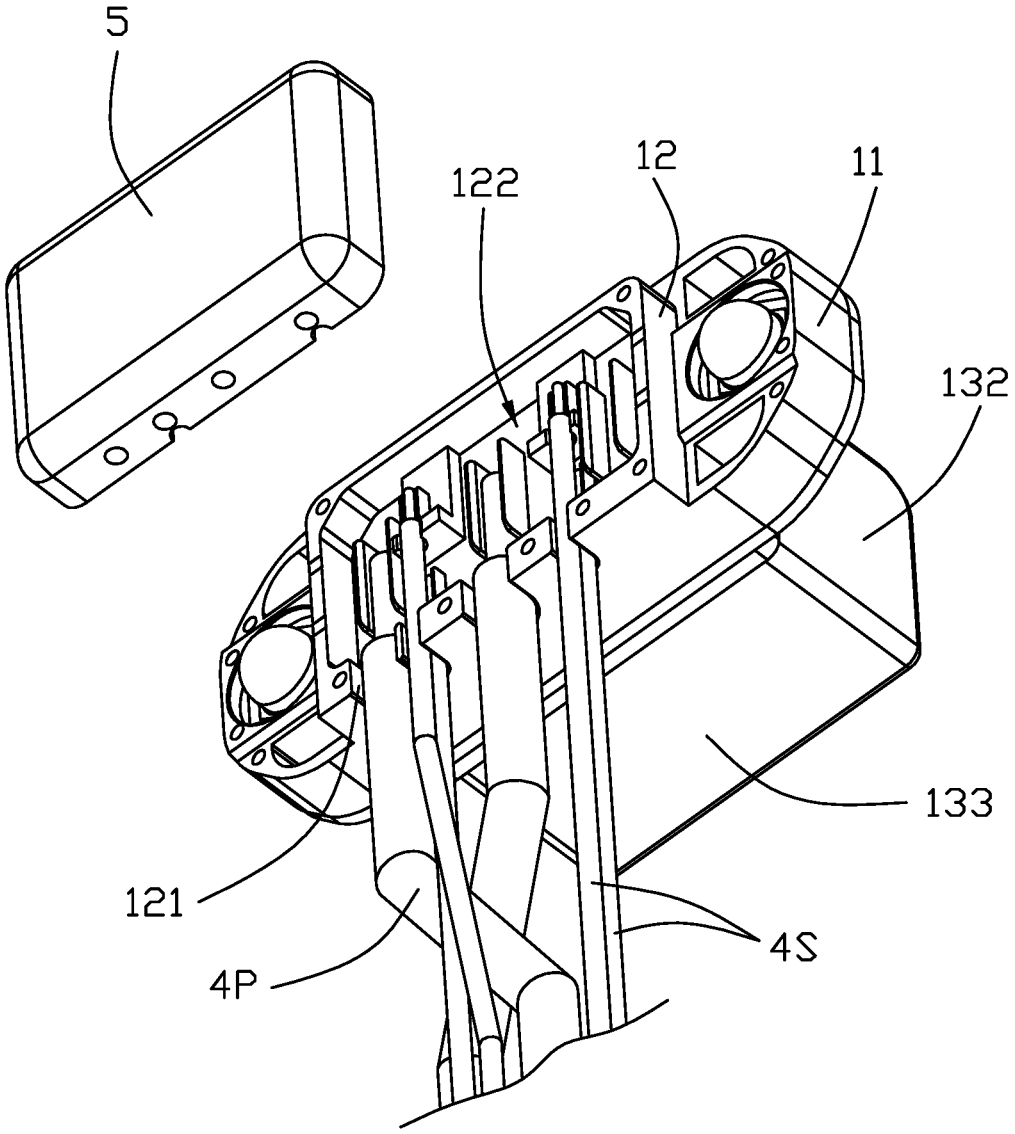
FIG. 4 is another exploded perspective view of the electrical connector of FIG. 3.
Figure 5:
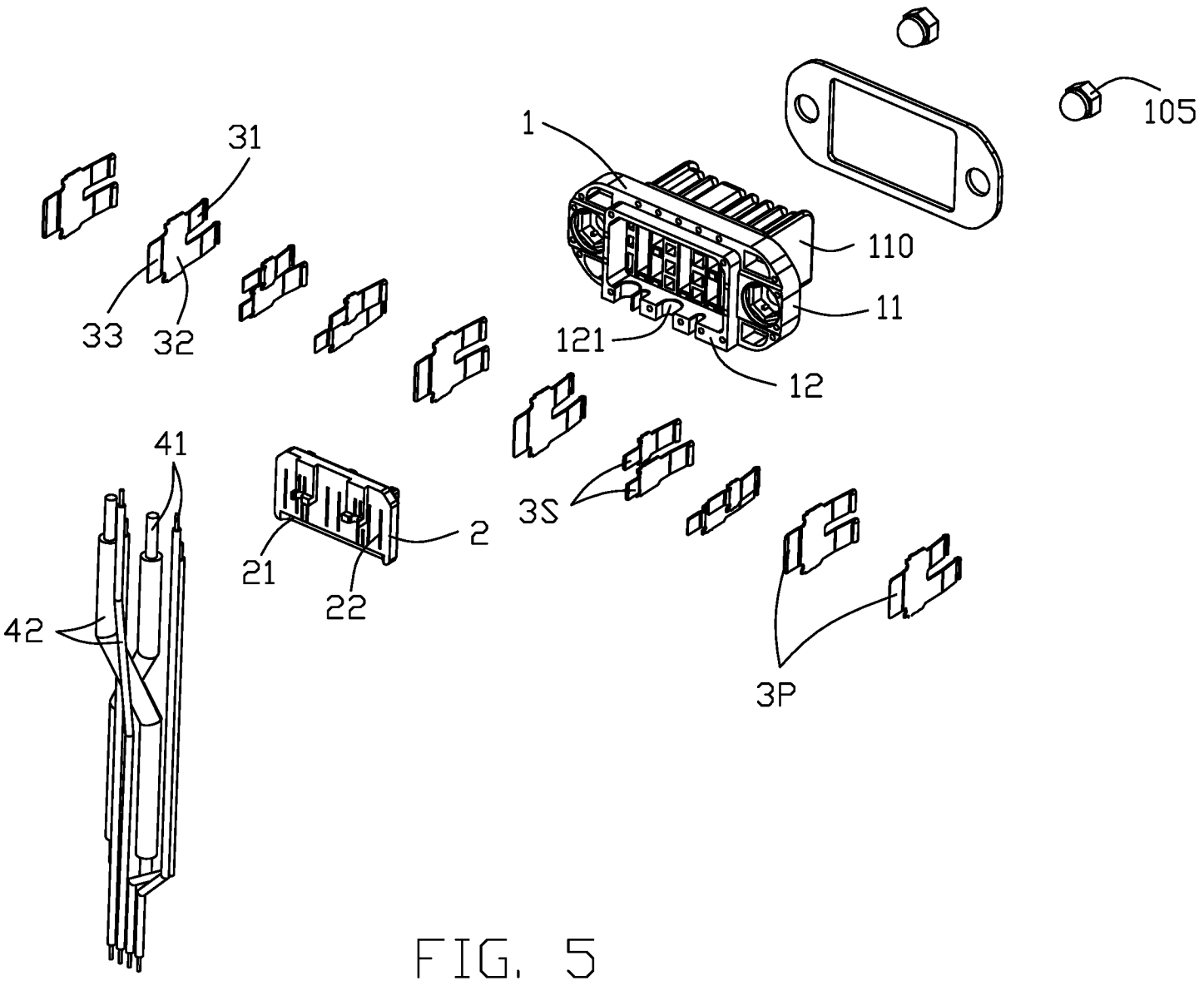
FIG. 5 is a further exploded perspective view of the electrical connector of FIG. 4.

As shown in FIGS. 4 and 7, the housing forms the corresponding passage 121 to receive a pair of signal wires 4S therein while the spacer forms a block 27 with therein another passage 271 to receive the upper one of the pair of signal wires 4S.

Figure 10:
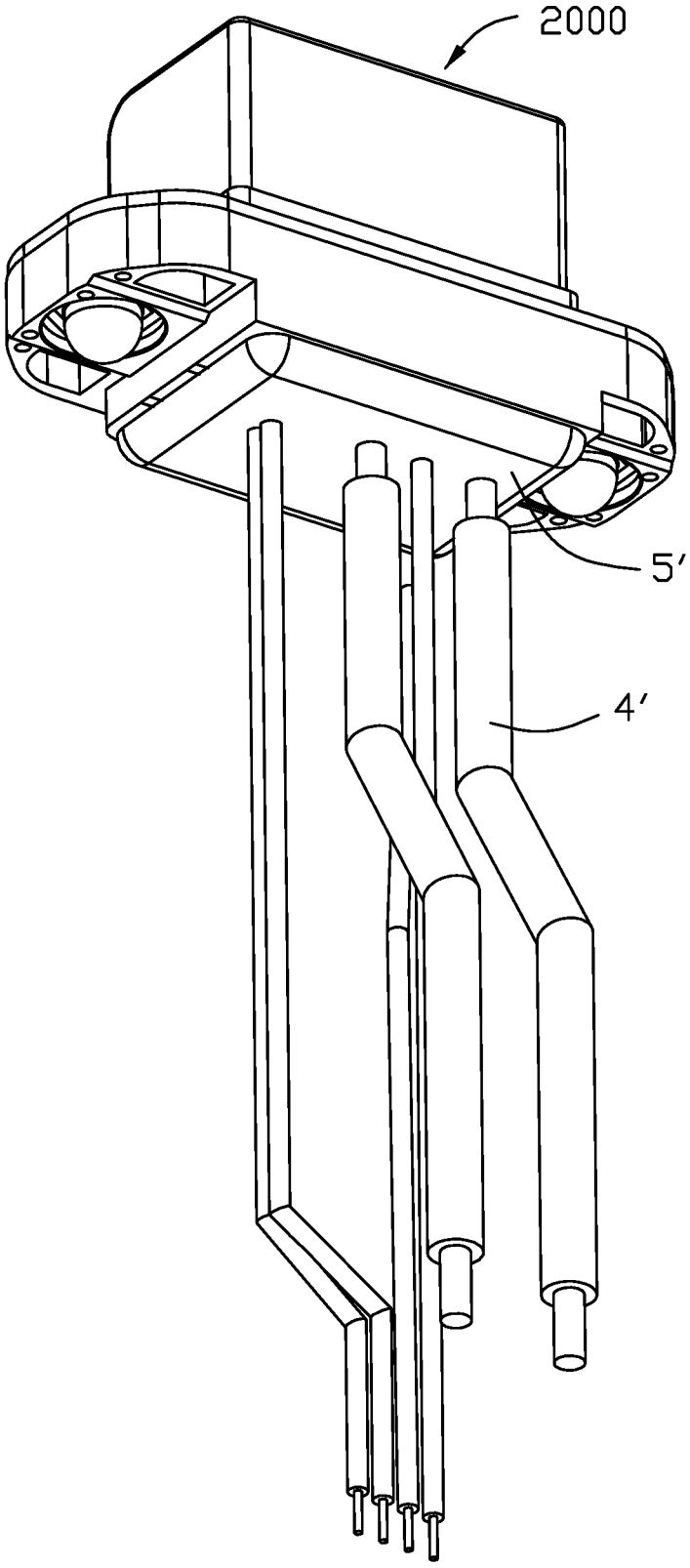
FIG. 10 is a perspective view of the electrical connector according to another embodiment of the invention.
Figure 11:
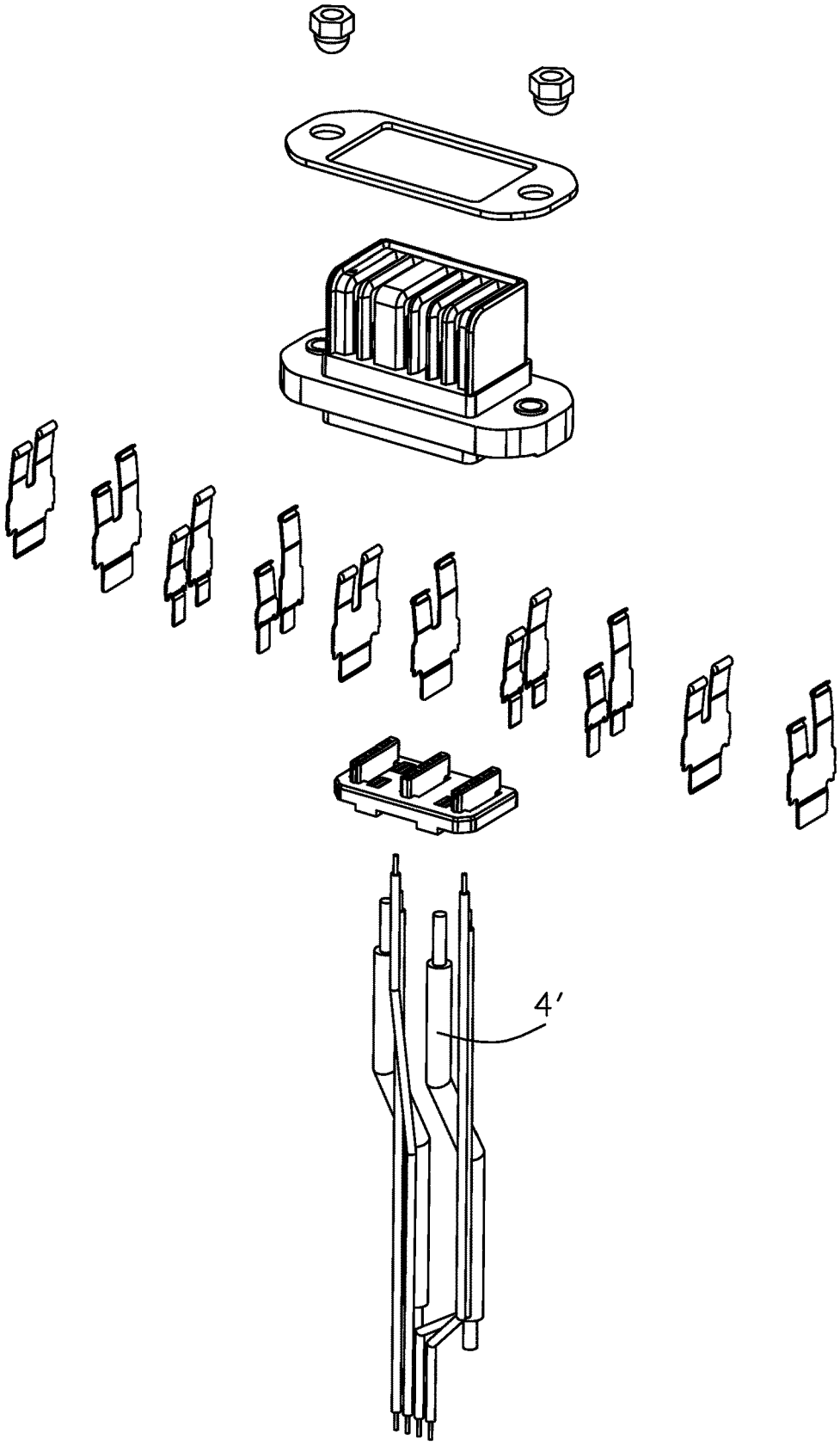
FIG. 11 is an exploded perspective view of the electrical connector of FIG. 10.
Figure 12:
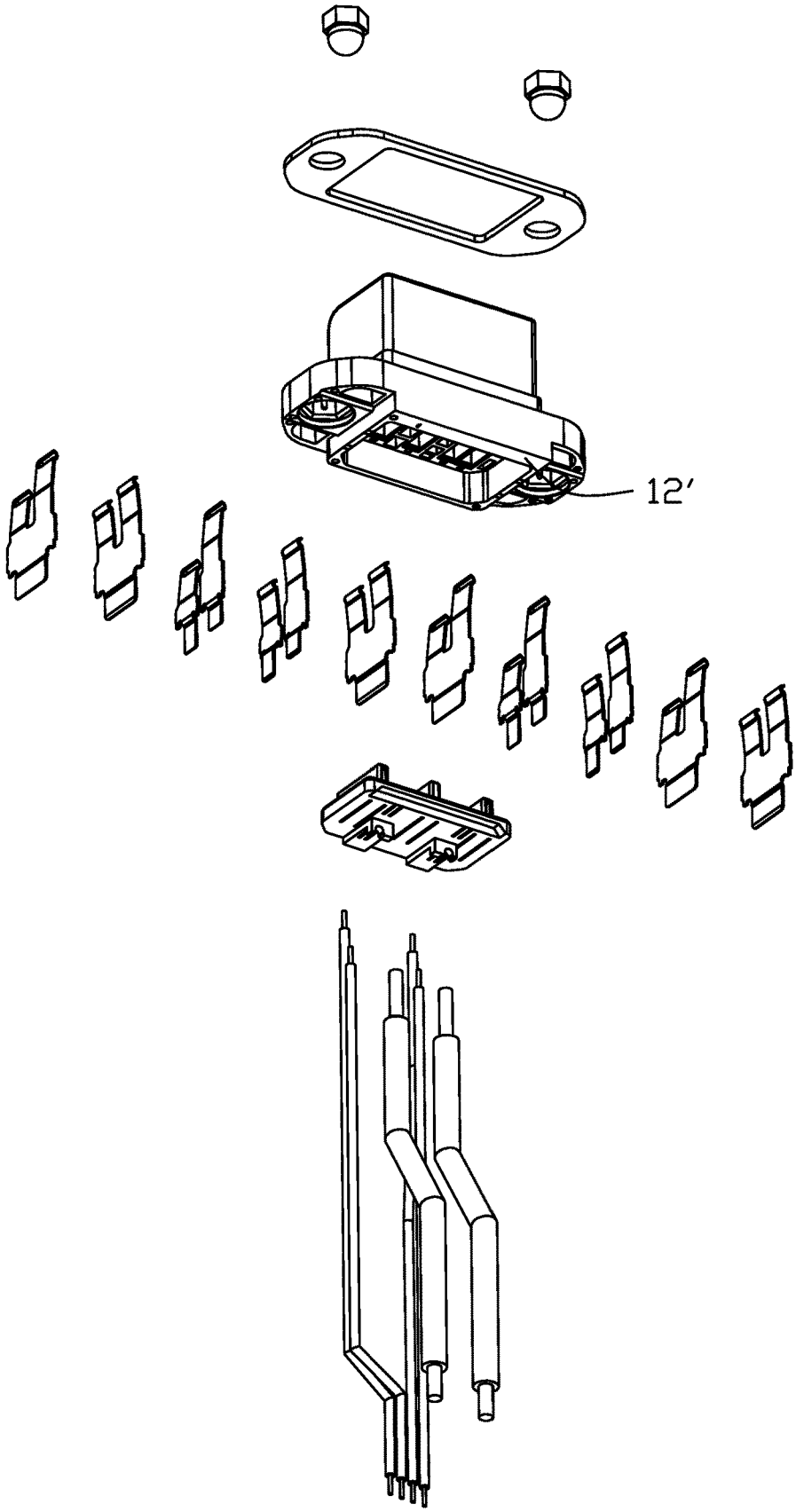
FIG. 12 is another exploded perspective view of the electrical connector of FIG. 10.

FIGS. 10-12 show another embodiment in which the wires extend in the horizontal direction same with the one along which the contacts extend.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including a base and a mating port forwardly extending from the base in a front-to-back direction, a rear receiving space formed in a rear side of the housing and surrounded by a peripheral wall of the housing;

a plurality of passageways formed in the base;

a plurality of contacts disposed in the passageways, each of said contacts including, along the front-to-back direction, a front contacting section exposed in the front mating port, a middle retaining section retained to the base, and a rear tail;

an insulative spacer received within the rear receiving space to cover the passageways, and the tails extending through the spacer and exposed in the rear receiving space; and a plurality of wires extending along a vertical direction perpendicular to the front-to-back direction and snugly received within corresponding passages formed in one side of the peripheral wall, each of said wires having an inner conductor enclosed within an insulator, the inner conductor mechanically and electrically connected to the tail of the corresponding contact;

a waterproof glue plate formed in the receiving space and located behind the spacer to cover the spacer and enclose the tails of the contacts and front end regions of the wires; wherein a recess is formed in the spacer around the side of the peripheral wall where the passages are formed, and the glue plate forms a protrusion retained in the recess for assuring sealing of the glue plate around said side of the peripheral wall.

2. The electrical connector as claimed in claim 1, wherein the passages rearwardly communicates with an exterior in the front-to-back direction.

3. The electrical connector as claimed in claim 1, wherein the front mating port forms a plurality of dividers to form corresponding slots therebetween, and the slots are aligned with the corresponding passageways in the front-to-back direction but narrower than the corresponding passageways in a transverse direction perpendicular to both the front-to-back direction and the vertical direction.

4. The electrical connector as claim 1, wherein the housing forms a pair of retaining grooves in each corresponding passageway in a transverse direction perpendicular to both the front-to-back direction and the vertical direction to receive the retaining sections of a pair of contacts, respectively.

5. The electrical connector as claimed in claim 1, wherein a plurality of stuffers are formed on a front face of the spacer to be received within the corresponding passageway, respectively.

6. The electrical connector as claimed in claim 5, wherein each stuffer transversely separates two contacts which are received within the same passageway.

7. The electrical connector as claimed in claim 6, wherein a pair of retaining grooves are formed in each passageway to receive the retaining sections of the pair of corresponding contacts therein.

8. The electrical connector as claimed in claim 1, wherein a plurality of blocks are formed on a rear face of the spacer with corresponding passages therein to receive corresponding wires therein.

9. The electrical connector as claimed in claim 8, wherein the passage of the spacer is aligned with one of the passages formed in the side of the peripheral wall, and the former receives one corresponding wire therein while the latter receives therein two corresponding wires including said corresponding one wire.

10. The electrical connector as claimed in claim 9, wherein said two corresponding wires are signal wires.

11. The electrical connector as claimed in claim 1, wherein the receiving space receives both the spacer and the glue plate.

12. The electrical connector as claimed in claim 10, wherein a rear portion of the receiving space is surround by the peripheral wall.

13. An electrical connector comprising:

an insulative housing including a base and a mating port forwardly extending from the base in a front-to-back direction, a rear receiving space formed in a rear side of the housing and surrounded by a peripheral wall of the housing;

a plurality of passageways formed in the base;

a plurality of contacts disposed in the passageways, each of said contacts including, along the front-to-back direction, a front contacting section exposed in the front mating port, a middle retaining section retained to the base, and a rear tail;

an insulative spacer received within the rear receiving space to cover the passageways, and the tails extending through the spacer and exposed in the rear receiving space; and a plurality of wires extending along a vertical direction perpendicular to the front-to-back direction and snugly received within corresponding passages formed in one side of the peripheral wall, each of said wires having an inner conductor enclosed within an insulator, the inner conductor mechanically and electrically connected to the tail of the corresponding contact;

a waterproof glue plate formed in the receiving space to cover the spacer and enclose the tails of the contacts and front end regions of the wires; wherein a plurality of stuffers are formed on a front face of the spacer to be received within the corresponding passageway, respectively.

14. The electrical connector as claimed in claim 12, where each stuffer transversely separates two contacts which are received within the same passageway.

15. The electrical connector as claimed in claim 12, wherein a plurality of blocks are formed on a rear face of the spacer with corresponding passages therein to receive corresponding wires therein.

16. The electrical connector as claimed in claim 14, wherein the passage of the spacer is aligned with one of the passages formed in the side of the peripheral wall, and the former receives one corresponding wire therein while the latter receives therein two corresponding wires including said corresponding one wire.

17. The electrical connector as claimed in claim 16, wherein all the passages in both the spacer and said side of the peripheral wall rearwardly communicate with an exterior in the front-to-back direction.

18. An electrical connector comprising:

an insulative housing including a base and a mating port forwardly extending from the base in a front-to-back direction, a rear receiving space formed in a rear side of the housing and surrounded by a peripheral wall of the housing;

a plurality of passageways formed in the base;

a plurality of contacts disposed in the passageways, each of said contacts including, along the front-to-back direction, a front contacting section exposed in the front mating port, a middle retaining section retained to the base, and a rear tail;

an insulative spacer received within the rear receiving space to cover the passageways, and the tails extending through the spacer and exposed in the rear receiving space; and a plurality of wires extending along a vertical direction perpendicular to the front-to-back direction and snugly received within corresponding passages formed in one side of the peripheral wall, each of said wires having an inner conductor enclosed within an insulator, the inner conductor mechanically and electrically connected to the tail of the corresponding contact;

a waterproof glue plate formed in the receiving space to cover the spacer and enclose the tails of the contacts and front end regions of the wires; wherein the front mating port forms a plurality of dividers to form corresponding slots therebetween, and the slots are aligned with the corresponding passageways in the front-to-back direction but narrower than the corresponding passageways in a transverse direction perpendicular to both the front-to-back direction and the vertical direction.

19. The electrical connector as claimed in claim 18, wherein there are four contacting sections are exposed in each of said slots.

20. The electrical connector as claimed in claim 19, wherein the four contacting sections form four different contacting points in the front-to-back direction while two levels in the vertical direction.

* * * * *